US005277051A

United States Patent [19]

Liu

[11] Patent Number: 5,277,051

[45] Date of Patent: Jan. 11, 1994

[54] TERMINAL POSITIONING DEVICE OF CRIMPING TOOL

[76] Inventor: Lien H. Liu, No 17, Alley 166, Lane 68, Sua-Yuan Rd., Feng-Yuan City, Taichung Hsien, Taiwan

[21] Appl. No.: 955,139

[22] Filed: Oct. 1, 1992

[51] Int. Cl.[5] ..... H01R 43/042

[52] U.S. Cl. ..... 72/410; 72/461; 29/751

[58] Field of Search ..... 72/410, 409, 416, 461; 29/751

[56] References Cited

U.S. PATENT DOCUMENTS

| | | | |
|---|---|---|---|
| 2,086,400 | 7/1937 | Brenizer | 72/410 |
| 2,359,083 | 9/1944 | Carlson | 72/410 |
| 3,039,337 | 6/1962 | Stuart-Prince | 72/410 |
| 3,420,086 | 1/1969 | Long | 29/751 |
| 3,494,171 | 2/1970 | Rapp | 29/751 |
| 3,553,999 | 1/1971 | Rommel | 72/410 |
| 3,673,848 | 7/1972 | Filia | 72/410 |
| 3,710,611 | 1/1973 | Filia | 72/410 |
| 4,590,786 | 5/1986 | Wiener | 72/461 |
| 5,042,286 | 8/1991 | Wiebe | 72/410 |

FOREIGN PATENT DOCUMENTS

| | | | |
|---|---|---|---|
| 12342 | 6/1969 | Japan | 72/410 |

*Primary Examiner*—Daniel C. Crane

*Attorney, Agent, or Firm*—Browdy and Neimark

[57] ABSTRACT

A terminal positioning device of crimping tool comprises mainly a base and an elastic member. The base is provided with a pair of clamping members mounted thereon. The elastic member is mounted on a predetermined location of the crimping tool and provided with a pressing portion of a length extending downwards to form jointly with the base and the clamping members a receiving space for accommodating and holding securely a terminal of any shape.

8 Claims, 3 Drawing Sheets

TERMINAL POSITIONING DEVICE OF CRIMPING TOOL

BACKGROUND OF THE INVENTION

The present invention relates to a crimping tool, and more particularly to a terminal connector positioning device of the crimping tool.

A prior art crimping tool is generally provided with clamping teeth serving to receive an end of a terminal connector. Another end of the terminal connector is arranged in a manner that it extends beyond the side of the crimping tool. It is often difficult to stabilize the terminal on the clamping teeth which have a relatively small holding area. As a result, an operator is required to hold firmly not only the crimping tool but also the terminal being worked on and the wire to be coupled, so as to prevent the terminal and the wire from moving aside. It is therefore often difficult for an operator to do a good job with such prior art crimping tool, which has inherent structural deficiencies.

With a view to overcoming the shortcomings of the prior art crimping tool described above, the U.S. Pat. Nos. 2,359,083 and 3,673,848 disclose respectively a crimping tool provided with a terminal holding means. However, such terminal holding means disclosed in the U.S. Pat. No. 2,359,083 is designed for use in adjusting the length of the portion of the terminal that extends beyond the side of the crimping tool holding the terminal. In addition, such terminal holding means is not able to hold firmly both sides of the portion of the terminal that extends beyond the side of the crimping tool. The U.S. Pat. No. 3,673,848 discloses a crimping tool equipped with a receiving space intended for accommodating the portion of the terminal that extends beyond the side of the crimping tool. However, such receiving space is limited in that it can accommodate only those terminals which have certain dimensions, in view of the fact that the receiving space is overcrowded with a spring. Moreover, a terminal of a round columnar construction or a circular fragmentary construction can not be positioned and held firmly in such receiving space.

SUMMARY OF THE INVENTION

It is, therefore, the primary objective of the present invention to provide a crimping tool with a terminal positioning means having a receiving space which can be adjusted to accommodate and hold firmly terminals of various dimensions.

It is another objective of the present invention to provide a crimping tool with means capable of holding firmly a terminal of a round columnar construction.

It is still another objective of the present invention to provide a crimping tool with means capable of holding firmly a terminal of a circular fragmentary construction.

In keeping with the principles of the present invention, the foregoing objectives of the present invention are accomplished by a crimping tool, which comprises a base mounted securely on a side of the crimping tool, a pair of clamping members mounted adjustably on the base, and a baffle mounted adjustably on the base, and a baffle mounted adjustably on one of the clamping members in a manner that its distance from the side of the crimping tool can be adjusted at will. A receiving space is therefore formed jointly by the base, the clamping members and the baffle and is provided with an opening which faces the lateral side of the clamping and connecting portion of the crimping tool. Such receiving space is intended for use in locating therein a terminal to be worked on.

The crimping tool of the present invention can be further provided with an elastic member having a free end capable of being moved in conjunction with the clamping and connecting portion. A crimper is disposed under the free end of the elastic member for locating the terminal at such time when the terminal is being clamped by the clamping and connecting portion of the crimping tool.

DETAILED DESCRIPTION OF THE PREFERRED EMBODIMENTS

Figure 1:
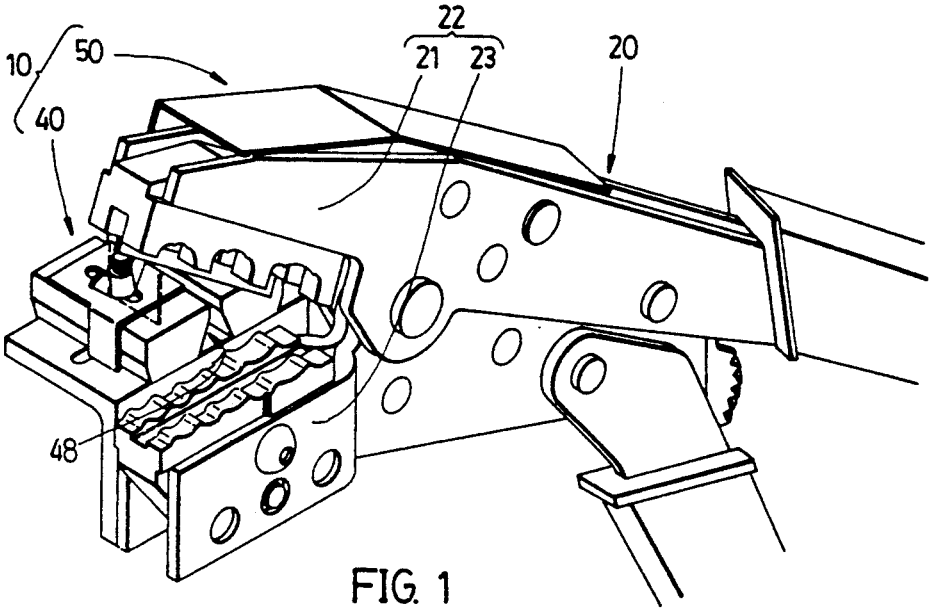
FIG. 1 shows a perspective view of a first preferred embodiment of the present invention.
Figure 2:
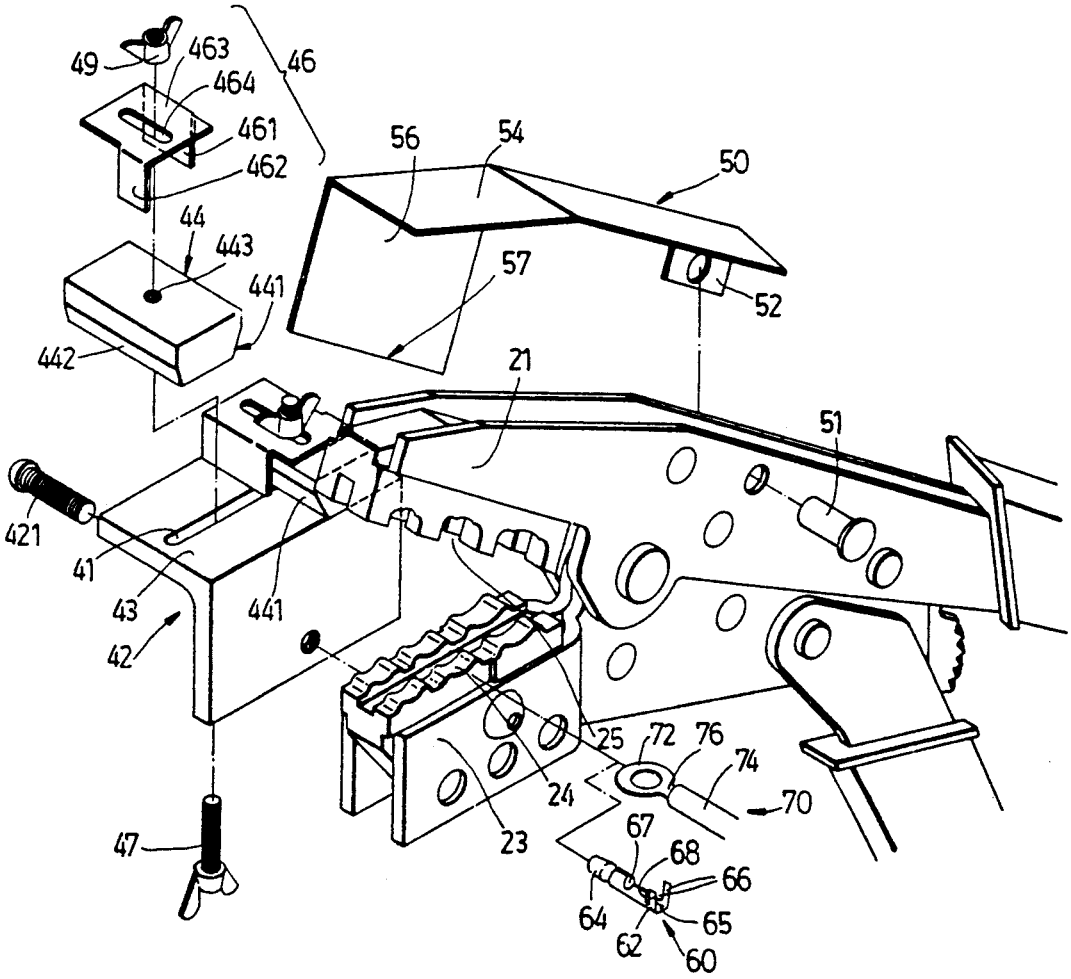
FIG. 2 shows an exploded view of the first preferred embodiment of the present invention.
Figure 3:
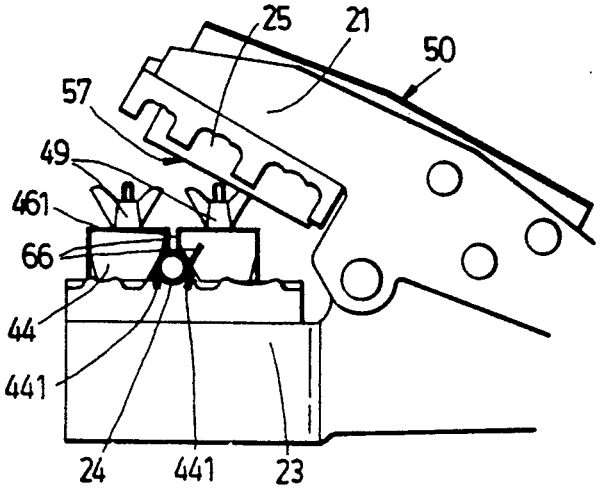
FIG. 3 is a front elevational view showing that a terminal is about to be clamped by the first preferred embodiment of the present invention.
Figure 4:
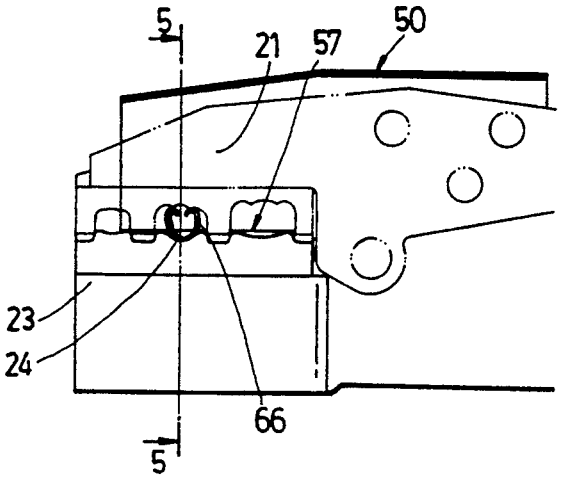
FIG. 4 is a front view showing that the terminal has been clamped by the first preferred embodiment of the present invention.
Figure 5:
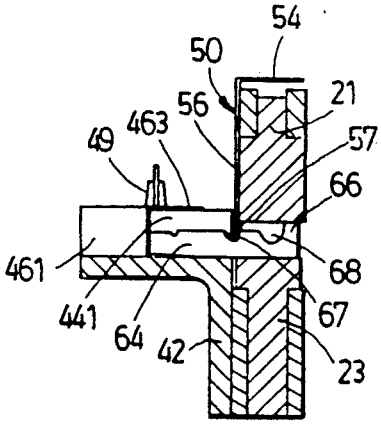
FIG. 5 shows a sectional view of a portion taken along a line 5—5 as shown in FIG. 4.

Referring to FIGS. 1–5, a terminal positioning device 10 of the present invention is shown to be mounted securely by a side of a clamping portion 22 of a crimping tool 20. The clamping portion 22 comprises an upper clamping portion 21 and a lower clamping portion 23, which move in opposite directions so as to clamp a terminal. The upper and the lower clamping portions 21 and 23 are provided respectively with a plurality of grooves 25 and teeth 24, which are opposite to each other. The terminal positioning device 10 comprises a placing portion 40 and an elastic piece 50.

The placing portion 40 comprises a base 42 fastened securely to the side of the lower clamping portion 23. The placing portion 40 has a flat upper surface 43 in alignment with the teeth 24. There are a first elongate hole 41 located on the base 42, and a pair of clamping members 44 mounted on the upper surface 43. Each of the clamping members 44 has a through threaded hole 443, a first clamping surface 441 and a second clamping surface 442 which are opposite to each other. The first and the second clamping surfaces 441 and 442 form respectively an angle with the upper surface 43. Each of the two baffles 46 is provided with a body portion 463 corresponding in location to each of the two clamping members 44. The body portion 463 is provided with a second elongate hole 464 parallel to the longitudinal axis of the clamping member 44 and with a first stopping portion 461 and a second stopping portion 462 which extend downward respectively from the two sides of the body portion 463. The clamping member 44 and the baffle 46 are fastened securely on the base 42 by means of a nut 49 and a bolt 47 passing through the first elongate hole 41, a threaded hole 443, and the second elongate hole 464. As a result, a receiving space 48 is formed jointly by the upper surface 43, the first clamping surface 441 and the first stopping portion 461.

The elastic piece 50 has a fixed end 52, which is fastened to the upper clamping portion 21 by means of a rivet 51, a free end 54 extending toward the open end of the clamping portion 22 from the upper portion of the crimping tool 20, and a pressing portion 56 of a predetermined length bending downwards from an end of the free end 54 and having a lower edge 57 which extends to reach the open end of the receiving space 48.

A first terminal 60 has an inner end 62 arranged on the teeth 24 and an outer end 64 placed in the receiving space 48. The periphery and the end of the outer end 64 are obstructed respectively by the first clamping surface 441 and the first stopping portion 461. Located at an open end 65 of the inner end 62 are two feet 66 extending outwards in a tangential direction. There are a first slot 67 located between the inner and the outer ends 62 and 64, and a second slot 68 situated between the feet 66 and the first slot 67.

If the first terminal 60 moves aside on the teeth 24, the operator of the crimping tool 20 may move the upper and the lower clamping portions 21 and 23 in opposite directions. As a result, the elastic piece 50 moves downwards along with the upper clamping portion 21. The lower edge 57 of the pressing portion 56 of the elastic piece 50 has a height that is between the upper and the lower clamping portions 21 and 23; therefore, the pressing portion 56 has touched the periphery of the terminal 60 at such time when the teeth 24 and the grooves 25 engage. In the meantime, the lower edge 57 is received in the first slot 67. As the engagement of the teeth 24 and the grooves 25 persists, the lower edge 57 of the pressing portion 56 remains in a horizontal position so as to press against the bottom portion of the first slot 67, thereby resulting in the first slot 67 to turn to remain in a vertical and upward state by a force generated by the fixed end 52 in response to the pressing of the lower edge 57 against the bottom portion of the first slot 67. Both feet 66 face upwards so as to permit the grooves 25 to press with precision against the peripheries of the feet 66 in order to force the feet 66 to bend inwards to join together.

Figure 6:
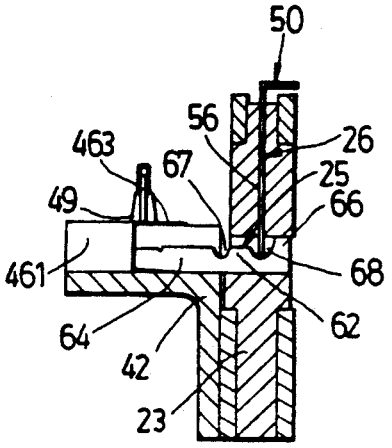
FIG. 6 shows a sectional view of a portion taken along a line 5—5 as shown in FIG. 4, according to a second preferred embodiment of the present invention.

In a second embodiment as shown in FIG. 6, the upper clamping portion 21 is further provided at the center thereof with a third elongate hole 26 in communication with the upper surface of the upper clamping portion 21 and the grooves 25. The lower edge 57 of the pressing portion 56 of the elastic piece 50 extends to reach a place between the teeth 24 and the grooves 25 via the third elongate hole 26. In operation, the lower edge 57 of the pressing portion 56 is in a state of pressing against the second slot 68 of the first terminal 60, so as to force both feet 66 of the inner end 62 to remain in a state facing and extending upwards.

Figure 7:
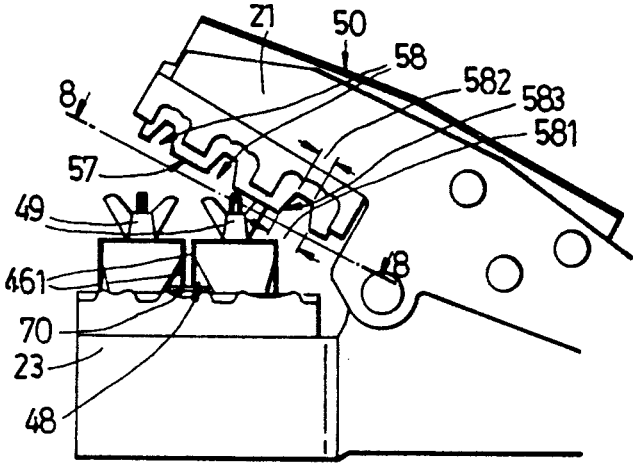
FIG. 7 shows a front view of a third preferred embodiment of the present invention.
Figure 8:
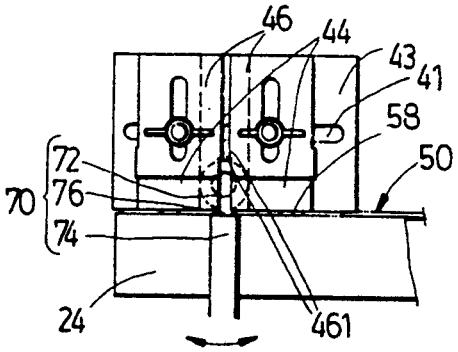
FIG. 8 shows a sectional view of a portion taken along a line 8—8 as shown in FIG. 7.

Now referring to a thread embodiment as shown FIGS. 7 and 8, the lower edge 57 of the pressing portion 56 is shown to comprise a plurality of cuts 58 facing downwards. Each of these cuts 58 is corresponding in location to the outside of the teeth 24 and has an open end 581 with a width greater than a width of a closed end 582. In other words, the cut 58 is progressively wider toward its open end 581 from its closed end 582.

The features of the third preferred embodiment of the present invention, as described above and as illustrated in FIGS. 7 and 8, are useful on an occasion when a second terminal 70 having an outer end 72 of a ring-shaped construction is to be worked on. After the outer end 72 has been placed in the receiving space 48, an inner end 74 tends to move aside and to bevel on the teeth 24. Such undesirable incident can be avoided, thanks to the cut 58, which can be lowered along with the clamping portion 22 to rest across the neck portion 76 situated between the inner and the outer ends 72 and 74. As a result, the neck portion 76 moves along the inner wall 583 of the cut 58 to a position parallel to the axis of the teeth 24 and ready for the upper and the lower clamping portions 21 and 23 to work thereon.

Figure 9:
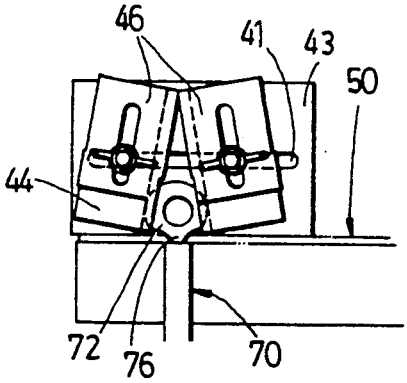
FIG. 9 shows a sectional view of a portion taken along a line 8—8 as shown in FIG. 7, according to a fourth preferred embodiment of the present invention.

Referring to FIG. 9, each of the clamping members 44 is shown to be mounted securely on the base 42 by means of a bolt 47 and a nut 49. As a result, the positions of both clamping members 44 and the distance between the two clamping members 44 and the distance between the two clamping members 44 can be adjusted at will by loosening the bolt 47, so as to adjust the width and the shape of the receiving space 48, which is shown to be triangular in shape and to have both open ends of different sizes.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the hereinafter appended claims.

What is claimed is:

1. A terminal connector positioning device for a crimping tool, said crimping tool having an upper clamping portion and a lower clamping portion which are opposite to each other and can be moved in opposite directions to join together to clamp a terminal connector to an end of a wire, said terminal connector positioning device comprising:

a base having means for mounting on only one side of said crimping tool;

two clamping members engaged on top of said base, at least one of said two clamping members provided with a baffle having a stopping portion extending between said two clamping members to form jointly with two opposite sides of said two clamping members a receiving space for a terminal connector, wherein said base is provided with a first slot having an axis parallel to said side of said crimping tool; each of said two clamping members having a threaded hole corresponding with said first slot to permit sliding and rotation of said each of said two clamping members on said base along said slot before being locked securely on said base by means of a bolt passing through said first slot and threaded in said threaded hole.

2. The terminal positioning device in accordance with claim 1, wherein said baffle has a body portion slideably engaged to a top of said clamping member, said body portion provided with a second slot through which said bolt extends, wherein said bolt permits adjustment of a distance between said stopping portion and said crimping tool before said baffle is locked securely to said at least one of said two clamping members by means of a nut threaded on said bolt.

3. The terminal positioning device in accordance with claim 1 further comprising an elastic member having a fixed end fastened securely to a predetermined location of said crimping tool and having a free end extending from a side of said fixed end toward the top of said base, said free end having a lower edge which is positioned so that a distance between said lower edge and said top of said base is smaller than a distance between said upper clamping portion and said lower clamping portion at such time when said free end is not exerted upon by a force, said free end being so arranged that, at the time when said free end is exerted upon by a force, said free end can move in directions parallel to directions in which both said upper clamping portion and said lower clamping portion move to join together.

4. The terminal positioning device in accordance with claim 3 wherein said upper clamping portion is provided at a center thereof with a slot of a size permitting said free end of said elastic member to pass therethrough to reach a place between said upper clamping portion and said lower clamping portion.

5. The terminal positioning device in accordance with claim 3 wherein said lower edge of said free end is provided with a plurality of cuts spaced at a predetermined interval.

6. The terminal positioning device in accordance with claim 3 wherein each of said cuts has an open end and a closed end, with said open end having a width greater than a width of said closed end.

7. The terminal positioning device in accordance with claim 3 wherein said lower edge of said free end is of a flat plate construction.

8. The terminal positioning device in accordance with claim 3 wherein said elastic member comprises:

a press board pivoted at the fixed end thereof to a predetermined position of said crimping tool, with a free end of said press board extending to reach over said base; and a spring fastened between said crimping tool and a predetermined position of said press board so as to cause said free end of said press board to move upwards and downwards between said upper clamping portion and said lower clamping portion.

* * * * *